US007063281B2

(12) United States Patent
Schommer

(10) Patent No.: US 7,063,281 B2
(45) Date of Patent: Jun. 20, 2006

(54) WATER CONSERVING AND CLEANING APPARATUS

(76) Inventor: John E. Schommer, 3612 Kingston St., Carlsbad, CA (US) 92008

( * ) Notice: Subject to any disclaimer, the term of this patent is extended or adjusted under 35 U.S.C. 154(b) by 366 days.

(21) Appl. No.: 09/901,155

(22) Filed: Jul. 10, 2001

(65) Prior Publication Data

US 2003/0010852 A1 Jan. 16, 2003

(51) Int. Cl.
*B05B 3/18* (2006.01)

(52) U.S. Cl. ..... 239/754; 239/532; 239/428.5

(58) Field of Classification Search ..... 239/754, 239/428.5, 532
See application file for complete search history.

(56) References Cited

U.S. PATENT DOCUMENTS 2,692,163 A * 10/1954 Geel ..... 239/754
2,746,072 A * 5/1956 Lumpkin ..... 401/48
3,877,643 A * 4/1975 Smith et al. ..... 239/102.1
3,998,387 A * 12/1976 Maasberg ..... 239/102.1
4,009,666 A * 3/1977 Russell et al. ..... 111/127
4,095,746 A 6/1978 Anderberg et al.
D250,826 S * 1/1979 Newman ..... D32/15
4,200,236 A * 4/1980 Briar ..... 15/361
4,730,786 A * 3/1988 Nelson ..... 239/590.3
4,930,706 A 6/1990 Merlin
5,548,866 A * 8/1996 Reed et al. ..... 15/320

* cited by examiner

*Primary Examiner*—Christopher Kim
(74) *Attorney, Agent, or Firm*—John L. Rogitz

(57) ABSTRACT

The present water conserving and cleaning apparatus' major components include an essentially straight handle of several feet in length, with a hand grip in the vicinity of a distal end and a water low control lever operably secured to a straight fixture removably secured to the hand grip. The handle is secured on the proximate end to a horizontal member in an inverted "T" configuration. A specific angle at which the handle is secured to the horizontal member is preferred for maximum comfort value for adults. The horizontal member includes a winged jet manifold fixably secured to the proximate end of the handle. The manifold includes a flow director which directs an air and water jet stream onto a surface to be cleaned. A rear wing, integral to the jet manifold, includes a two level cantilevered porch with specifically designed angles and heights to provide optimum air flow and a Venturi effect under the cleaning apparatus. A minimum of water is required when combined with an air stream to provide maximum pressure at a specific target angle to the surface to be cleaned. In addition, a cylindrical horizontal length of pipe is integrally manufactured into the manifold. Also, a plurality of spray nozzles are secured underneath the horizontal length of the cylinder at generally equally spaced intervals. Finally, on a rear side of the manifold is movably secured a plurality of wheels. Several embodiments demonstrate design flexibility and adaptability to a variety of surface cleaning uses.

14 Claims, 5 Drawing Sheets

WATER CONSERVING AND CLEANING APPARATUS

BACKGROUND OF THE INVENTION

1. Field of the Invention

The present invention relates generally to watering devices. More particularly, the present invention relates to manually operated watering devices used to clean surfaces by using water and air at a predesignated pressure and direction.

2. Description of the Related Art

Manually operated cleaning devices using water are well-known. Devices using many different styles, materials, and performing varying functions have been patented. More specifically, numerous cleaning devices known as water brooms have been invented. The purpose of these devices is generally to clean surfaces, such as tennis courts, driveways, pool decks and commercial sidewalks, patios or parking lots.

Unfortunately, patented inventions in this field still exhibit many problems and disadvantages which the present invention has overcome. Even though previous designs have had some success in overcoming past problems, one long standing problem of prior art devices is an inability to conserve water. Still another problem is that prior art designs include relatively non-durable devices. Yet another problem in the prior art is the lack of flexibility in the design.

Some of the related prior art includes the following U.S. Patents: Anderberg, et. al., U.S. Pat. No. 4,095,746 and Merlin, U.S. Pat. No. 4,930,706. Anderberg discloses a surface cleaning apparatus which " . . . provides a plurality of overlapping spray patterns . . . " and also is directed to " . . . one of said plurality of spray nozzles being mounted at said junction . . . to deflect liquid flow . . . " One problem with Anderberg's disclosure is that the nozzles are not protected from damage. Therefore, the nozzles are not durable. A second problem is that no teaching is made to linking highly effective cleaning of surface with dramatic water conservation. The only reference seems to be describing a spray pattern with " . . . minimizing the volume of water impinging on the surface for cleaning." No novel details are disclosed. Another problem is the lack of a flexible design, preventing accommodating the needs of different users. In fact, Anderberg teaches away from the present invention's novel features.

Merlin discloses " . . . a fluid spray apparatus with resilient shank portion which is compressedly seated in its aperture and a resilient flange portion . . . in pressure sealing engagement." Primarily Merlin is directed towards a technique permitting removal of nozzles for cleaning yet providing for nozzle alignment and sealing once reinstalled. One problem with Merlin's disclosure is that the nozzles are not protected from damage. A second problem is that no teaching is made which links cleaning of a surface with water conservation. Another problem is the lack of a flexible design, preventing accommodating the needs of different users. In fact, Merlin teaches away from the present invention.

In summary, the cited patents have a multitude of problems and disadvantages. As is quickly realized, the cited patents disclose attempts to solve only one or two problems associated with previous cleaning devices using water. All of them rely solely on a high volume of water at a high water pressure for cleaning. None use air to assist in cleaning, nor do any use air to conserve water. One attempts to improve the spray pattern. Another attempts to provide a nozzle which is easier to clean. However, problems still exist in the prior art which have not been addressed to the knowledge of the Applicant. These problems are solved with an elegant, simple, and inexpensive design. In addition, the present invention solves other problems in the field that have been virtually ignored.

Therefore, it is an object of the present invention to provide a durable device which will last a long time after many uses. Another object is to provide a device which provides dramatic water conservation features, while still thoroughly cleaning a surface. Still another object is to provide an elegantly simple and inexpensively manufactured design, including a flexible design accommodating the needs of different users and supporting a variety of devices. The Applicant thinks the present invention overcomes many long-standing and even ignored problems and disadvantages of the prior art.

SUMMARY OF THE INVENTION

The above-mentioned difficulties and problems of the prior art are overcome by the present invention. The present water conserving and cleaning apparatus' major components include an essentially straight handle of several feet in length, with a hand grip in the vicinity of a distal end, a straight, preferably brass, fixture, and a water flow control lever operably secured to the fixture. The handle is secured on the proximate end to a horizontal member in an inverted "T" configuration. One novel feature is the is angle at which the handle is secured to the horizontal member. The specific angle has been determined through testing to be the preferred for maximum comfort value to the widest group of adults of virtually any age and height. The horizontal member includes a winged jet manifold fixably secured to the proximate end of the handle.

The many novel features of the manifold include a flow director which forces an air and water jet stream onto a surface to be cleaned. Another novel feature is a rear wing. The rear wing, integral (extruded) to the jet manifold, includes a two level cantilevered porch with specifically designed angles and heights to provide optimum air flow and a Venturi effect under the water conserving apparatus. Thus, a minimum of water is required when combined with an air stream to provide maximum pressure at a specific target angle to the surface to be cleaned. Therefore, complete and rapid cleaning is achieved with an order of magnitude savings in water conservation when compared to the prior art. In addition, a cylindrical horizontal length of pipe is integrally manufactured (extruded) into the manifold. Also, a plurality of spray nozzles are secured along the horizontal length of the pipe at generally equally spaced intervals. Finally, on a rear side of the manifold is movably secured a plurality of wheels.

Several embodiments of the present invention demonstrate the design flexibility and adaptability to a variety of surface cleaning uses. These uses include firehouses, hotels, schools, and boats of all sizes and uses.

These, and other, novel features and advantages of the present invention are set forth more completely in the accompanying drawings and the following description.

BRIEF DESCRIPTION OF THE DRAWINGS

Details of the invention, and of the preferred embodiment thereof, will be further understood upon reference to the drawings, wherein closely related elements have the same number but different alphabetical suffixes, and further wherein.

DETAILED DESCRIPTION OF THE PREFERRED EMBODIMENTS

The above-mentioned difficulties and problems of the prior art are overcome by the present invention. Referring initially to FIG. 1*a*, a perspective view of an invention of the prior art is shown. A typical waterbroom 1 is seen including a horizontal pipe member 2.

Figure 1B:
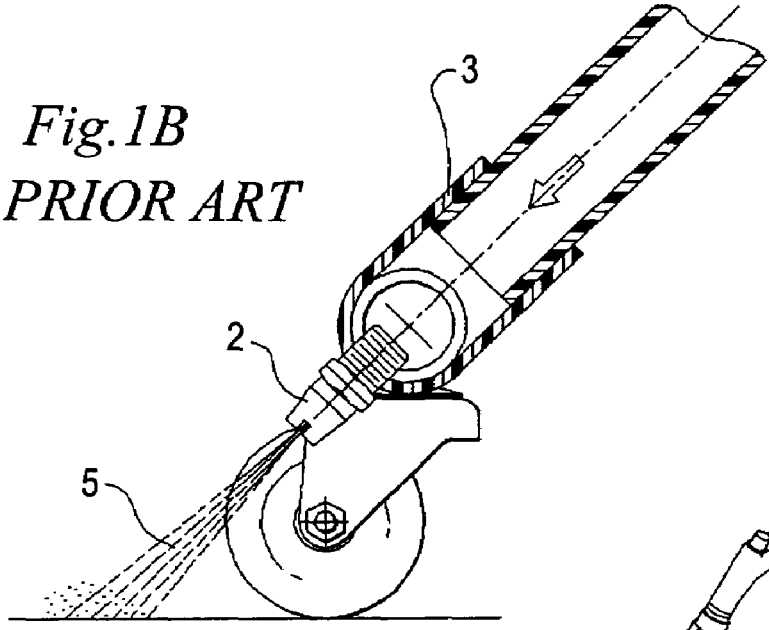
Fig.1B PRIOR ART
FIG. 1*b* is a right elevation view in partial section of the prior art device in FIG. 1*a*, illustrating a portion of a handle, a typical nozzle, and a typical spray pattern.
Figure 1A:
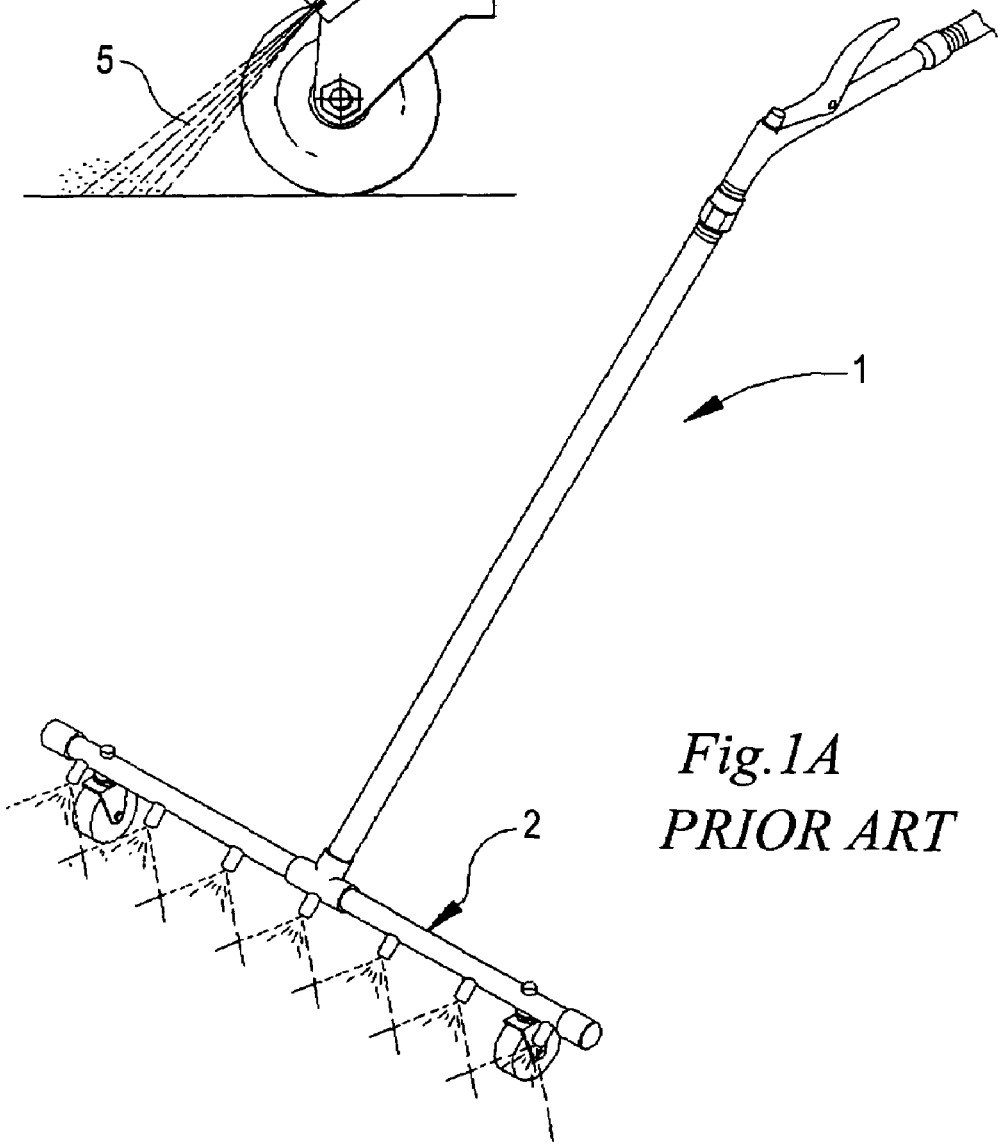
Fig.1A PRIOR ART
FIG. 1*a* is a perspective view of a prior art device.

Referring next to FIG. 1*b*, a right elevation view in partial section of the prior art device of FIG. 1*a* is shown, illustrating a portion of a handle 3 into which a typical nozzle 4 is secured. In addition, a typical spray pattern 5 from the nozzle 4 is shown.

Figure 2:
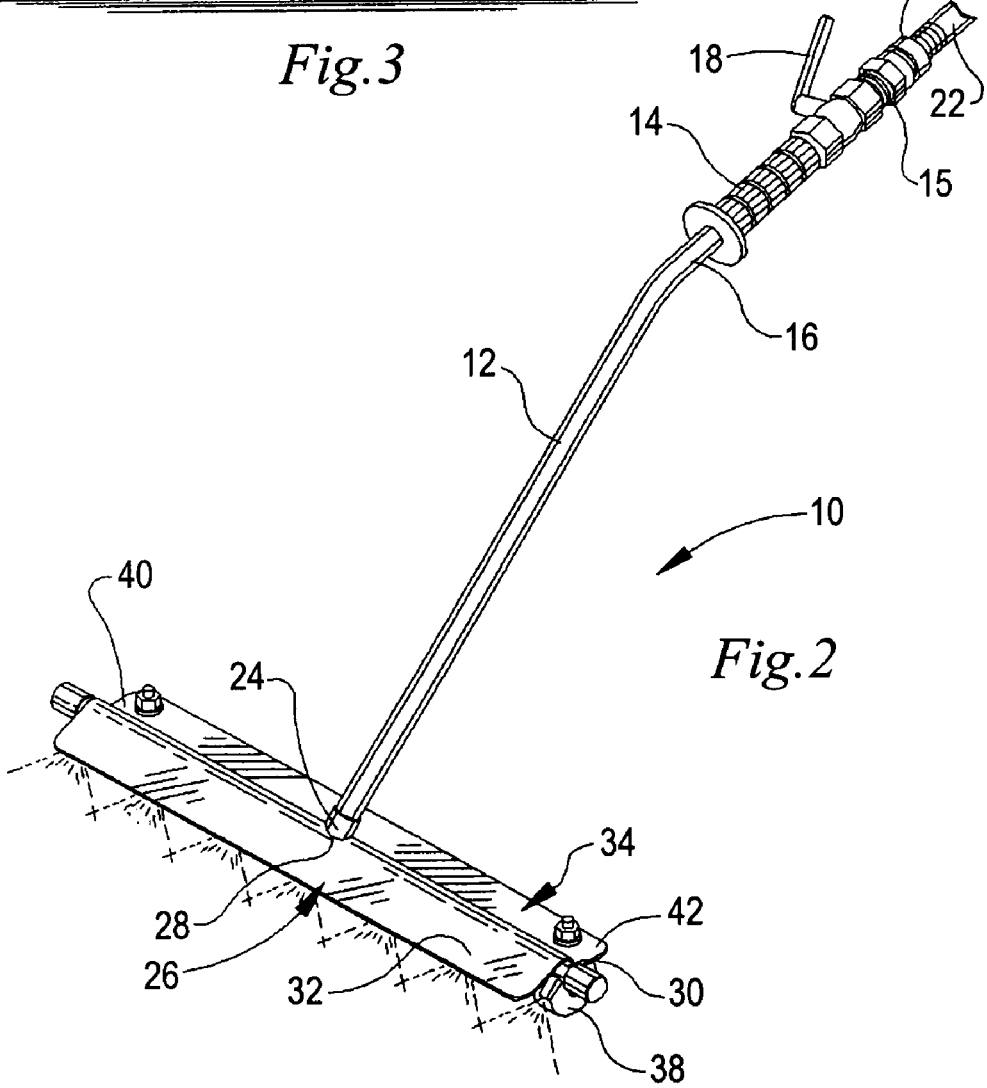
FIG. 2 is a perspective view of one embodiment of the present invention.

Referring now to FIG. 2, a perspective view of one embodiment of the present invention is shown. A water conserving and cleaning apparatus 10 comprises numerous major components, including an essentially straight handle 12 of several feet in length, with a hand grip 14 formed around the handle 12 proximate to a distal end 16 of the handle 12. The hand grip 14 is manufactured from a non-slip insulating material to prevent potential harm to a user in case hot water is used for cleaning, instead of water at ambient temperature. Removably screwed into the hand grip 14 portion of the handle 12 is a straight, preferably brass, fixture 15 with a water flow control lever 18 operably secured to the fixture 15. The control lever 18 is essentially an on/off lever. However, the lever 18 is designed to enable intermediate positions to be chosen for user control of water pressure. At one end 20 of the fixture 15, a water hose 22 is typically screwed into the one end 20. The handle 12 is fixedly secured on the proximate end 24 to a jet manifold 26 in an inverted "T" configuration. The jet manifold 26 is fixably secured to the handle 12 in approximately a center 28 of the manifold 26. More specifically, the preferred method of securing the handle 12 to the manifold 26 is by welding. The preferred material for most of the present invention is aluminum. More specifically, 6061 T-6 schedule 40 aluminum or stronger is preferred. For instance, the handle and most of the jet manifold are made from aluminum. Aluminum is easily manufactured, is lightweight and inexpensive. However, other materials with similar characteristics may be found suitable. When one compares FIG. 2 with FIG. 1*a*, the form differences are immediately obvious.

The jet manifold 26 is further comprised of numerous elements. A horizontal cylinder 30, a forward wing 32, and a rear wing 34 are the three major elements. All three 30, 32, and 34 are extruded from a single piece of aluminum, then welded onto the handle 12. In addition, a plurality of spray nozzles 36 (not seen) are secured into the cylinder 30 at equally spaced intervals. Also, a plurality of wheels 38 are movably secured proximate to left 40 and right ends 42 of the rear wing 34.

Figure 3:
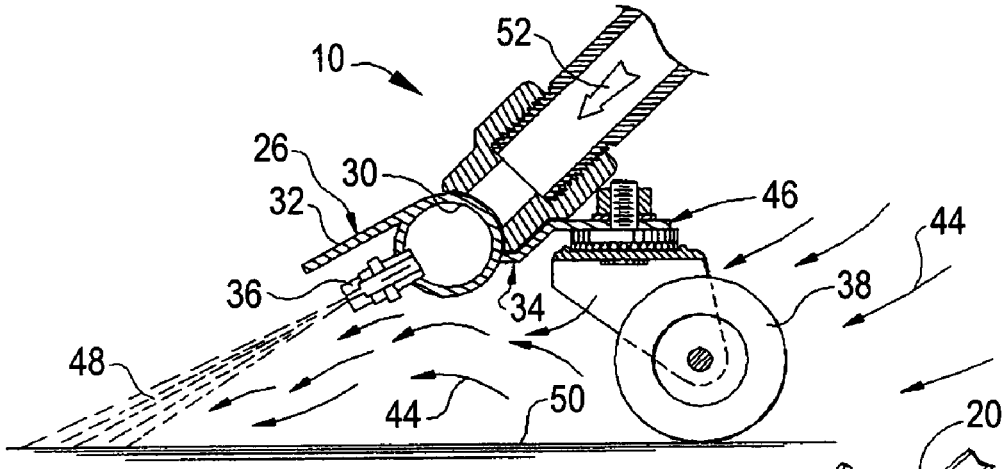
FIG. 3 is a right elevation view in partial section of the present invention in FIG. 2, illustrating a jet manifold protecting a nozzle and directing air and water flow.

Next, referring to FIG. 3, a right elevation view in partial section of the present invention in FIG. 2 is shown, illustrating the jet manifold 26 protecting one of the plurality of typical spray nozzles 36. This protection feature is novel when compared to the prior art. Also illustrated is the jet manifold 26 directing air flow 44. Yet another novel feature is the rear wing 34. The rear wing 34, integral to the jet manifold 26, includes a two level cantilevered porch 46 with specifically designed angles and heights to provide optimum air flow 44 and a Venturi effect under the water conserving apparatus 10. The rear wing 34 functions as a fluid flow director, directing the air flow 44 under the water conserving apparatus 10. Another of the many novel features of the manifold 26 includes the forward wing 32 which also functions as a fluid flow director. The forward wing 32 directs an air and water jet stream 48 onto a surface 50 to be cleaned. These last two described features have novel functions when compared to the prior art.

When the water conserving apparatus 10 is turned on at one of several predetermined water pressures, water 52 flows down the handle into the plurality of spray nozzles 36. The preferred water pressures have been demonstrated to be 40–80 pounds per square inch (psi). This pressure range is already the range delivered by virtually all known water districts to faucets throughout their service areas. As the water 52 exits each of the plurality of spray nozzles 36 virtually simultaneously, the water stream sucks air under the rear wing 34 and into the water stream. In other words, a Venturi effect is created. Therefore, no loss of water or loss of water pressure is created because the forward wing 32 directs both the combined water and air jet stream 48 onto the surface 50 to be cleaned. Thus, a minimum of water is required because it is combined with an air stream to provide maximum pressure at a specific target angle to the surface 50 to be cleaned.

Repeated testing has shown a mere two to three gallons per minute (2–3 gpm) is all that is required for optimum cleaning of most surfaces. Therefore, complete and rapid cleaning is achieved with almost an order of magnitude savings in water conservation when compared to the prior art. Typical prior art devices require at least eight to 18 gallons per minute (8–18 gpm) for cleaning a surface. Therefore, the water conservation feature is a novel one compared to the prior art. In addition, the water conservation feature provides another advantage to the user. With less water on the surface, it takes that much less time to dry completely, thereby allowing the surfaces to be more quickly available for customers. The water conserving and cleaning apparatus 10 cleans and removes dust, dirt, food spills, leaves, litter, sawdust and bird droppings from concrete, asphalt, aggregate, or any other composition hard surface. Additional specific surfaces which can be cleaned by the present invention include kitchen floors, mats, waste disposal areas, garage floors, entryways and many others.

An easily available spray nozzle is manufactured under the name VeeJet™. Two preferred capacity sizes are their 8004 and 8006 nozzles. For example, the 8004 provides 0.49 gpm at 60 psi. The 8006 provides 0.73 gpm at 60 gpm. Using the same data table, one calculates total gallons per minute by multiplying the number of gallons per minute for a specified nozzle size by the number of nozzles at a specific water pressure to determine total gpm delivered onto a surface to be cleaned. Following is a sample and typical calculation.

(@40 psi) 0.40 gpm/nozzle×7 nozzles=2.8 gpm (total)

For the most difficult cleaning tasks, higher volume and velocity nozzles can be added in another embodiment to create a range of 5–7 gpm delivered onto a surface. This range of 5–7 gpm still provides significant savings in water required when compared to the 8–18 gpm previously mentioned.

Figure 4:
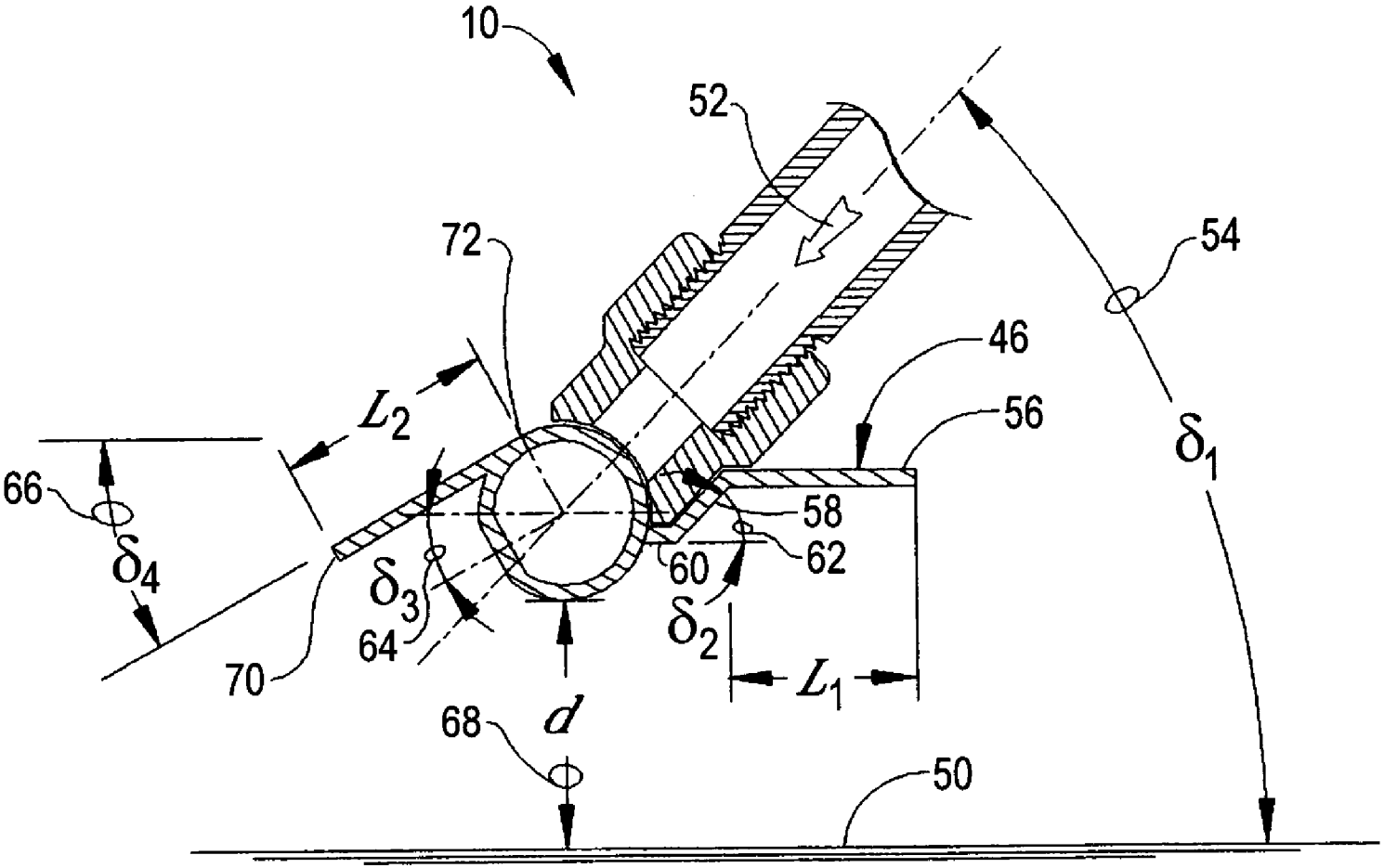
FIG. 4 is an enlarged detailed partial section of a right elevation view of the present invention of FIG. 2.

Referring now to FIG. 4, an enlarged detailed partial section of a right elevation view of the present invention of FIG. 2 is shown. One novel feature is an angle $\partial_1$ 54 at which the handle 12 is secured to the horizontal cylindrical member 30. The specific angle $\partial_1$ 54 has been determined through empirical testing to be the preferred angle for maximum comfort value to the widest group of adults of virtually any age and height. Preferably, the range of angle $\partial_1$ is from 45 to 50 degrees. The most preferred angle $\partial_1$ 54 is 47 degrees. This angle is a novel one. The preferred range is 45 to 50 degrees. Maximum comfort means holding the hand grip 14 essentially horizontal to the surface 50 to be cleaned.

The rear wing 34, integral to the jet manifold 26, includes the two level cantilevered porch 46 with specifically designed angles, lengths, and heights to provide optimum air flow and a Venturi effect under the water conserving apparatus 10. The porch 46 further comprises an upper horizontal porch 56. The upper porch 56 functions as an air flow director for the air flow 44 flowing underneath the water conserving apparatus 10. More specifically, the upper porch 56 is preferably of a length $L_1$ of 1.250 inches. An angle step 58 is extruded into the upper porch 56, and the angle step 58 is also extruded into a lower porch 60 portion of the cantilevered porch 46. In other words, the angle step 58, upper porch 56, and lower porch 60 are all extruded as one piece. Another angle $\partial_2$ 62 is identical to $\partial_1$ 54, that is preferably 47 degrees.

Another novel feature is a third angle $\partial_3$ 64 made to the horizontal by the spray nozzles 36. This angle $\partial_3$ 64 is preferably 30 degrees. Empirical testing of eight different angles, in approximately five degree increments, revealed that 25 degrees was too small an angle and 35 degrees was too large. This most preferred angle $\partial_3$ 64 is optimum for dirt penetration, particle dislodging and removal, and pushing debris such as leaves and dirt. The forward wing 32, which functions as another fluid flow director, directs the air and water stream 48. The forward wing 32 is also at an angle $\partial_4$ 66 to the horizontal of preferably 30 degrees. In other words, the plurality of spray nozzles 36 are parallel to the forward wing 32. Another dimension of novel importance is a length $L_2$. This length is the dimension underneath the forward wing 32 from its forward edge 70 to a juncture 72 where it joins the cylinder 30. The length $L_2$ is preferably 1.5 inches. More specifically, the length L2 is the distance from the forward edge 70 to the center of the cylinder 30. Another way of describing a dimension of the forward wing 32 is to state that the distance from the cylinder 30 to the forward edge 70 is 1.0 inch. This length $L_2$ provides the necessary length to function as an effective fluid flow director for the air and water stream 48. In addition to the above-mentioned novel features, another dimension is novel. More specifically, a distance "d" 68 is most preferably 1.8 inches above the surface 50 to be cleaned. Empirical testing resulted in a preferred range of 1.75 to 1.85 inches. Furthermore, testing resulted in learning that 1.5 inches was too low a distance, while 2.0 inches was too high off the surface 50. The distance "d" 68 provides another crucial dimension in combination with $\partial_1$ 54, $\partial_2$ 62, $\partial_3$ 64, $\partial_4$ 66, $L_1$ and $L_2$. The distance "d" 68 allows maximum drafting of air into the air and water stream 48, thereby creating the strongest Venturi effect.

Figure 5:
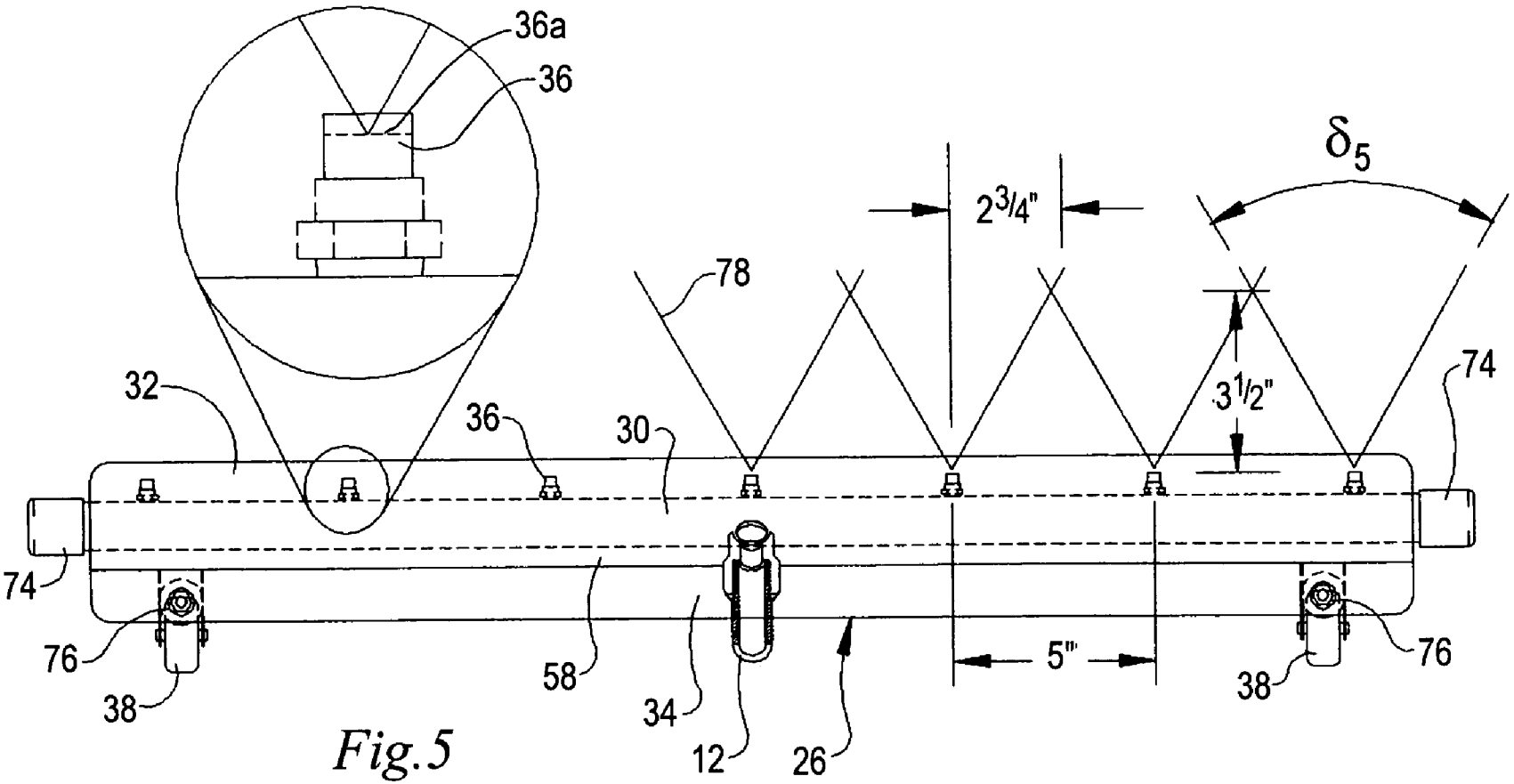
FIG. 5 is an enlarged plan view of the jet manifold of FIG. 3.

Referring next to FIG. 5, an enlarged plan view of the jet manifold 26 of FIG. 3 is shown. More clearly seen in this FIG. 5 are the numerous elements previously described or mentioned in one or more of FIGS. 1–4. In addition, the horizontal cylinder 30 is integrally manufactured (extruded) into the manifold 26. Also, the plurality of spray nozzles 36 are secured along the horizontal length of the cylinder 30 at generally equally spaced intervals. Finally, on the rear wing 34 of the manifold 26 are movably secured the plurality of wheels 38. At each opposing end of the cylinder 30 is located a cylinder leak stop 74. Each stop 74 is removably secured in the cylinder 30 by two preferred means.

First, the stop 74 may be screwed in using a threaded end on the stop 74, as well as in the cylinder 30. Another preferred way is by welding each stop 74 into each end of the cylinder 30. The leak stop 74 is a cap, preferably of durable, yet wearable, plastic. The purposes of each leak stop 74 are two fold. First, the stop 74 prevents the water 52 under pressure from leaking out of the cylinder 30, thereby reducing the water pressure. Second, the stop 74 provides a means of protecting vertical surfaces and objects encountered during the cleaning process. More specifically, when one of the stops 74 touches a surface or object, the plastic material does not scratch that surface. In addition, the plastic is chosen for its quality of wearing over time as it touches, or rubs or bumps into other objects or surfaces. Two types of material which are suitable include PVC or ABS plastic. This feature is an advantage for customers because no repairs or unsightly scratches are made to the customer's furnishings or facility. More specifically, the present invention will not damage such surfaces as a customer's stucco, painted walls, tile, brick work, or colored blocks.

More clearly seen also are the forward wing 32, the angle step 58, and the rear wing 34 of the jet manifold 26. Also more clearly seen is an attachment mechanism 76 which allows the plurality of wheels 38 to move freely when the water conserving apparatus 10 is in use. The exploded view of a nozzle 36 illustrates that each of the spray nozzles 36 are hidden in this view, underneath the forward wing 32 of the jet manifold 26. Each of the nozzles 36 are secured into the jet manifold 26 so that its slot 36*a* is oriented 90 degrees so that the slot 36*a* is essentially parallel to the front wing 32.

Several embodiments of the present invention demonstrate the design flexibility and adaptability to a variety of surface cleaning uses. These uses include firehouses, hotels, schools, and boats of all sizes and uses. The embodiment shown in FIG. 5 is the seven nozzle model. Other embodiments include a four nozzle model, a five nozzle model, a six nozzle model, and a nine nozzle model. All of these embodiments are manufactured in virtually the identical way as the representative seven nozzle embodiment. The purpose of the four and five nozzle models is for use on tasks with quite narrow passages or walk ways, such as found in brick, tile or stone steps in gardens, or on boats. In schools, a narrow embodiment is needed to clean around and under benches in patio areas and open air cafeterias. Also, boats often have non-skid surfaces and wooden decks which require thorough cleaning, particularly on fishing boats. The nine nozzle embodiment is particularly effective for the heavy commercial and industrial uses which have larger surfaces to clean. Larger surfaces mean more water is required to clean them. Therefore, more nozzles mean a quicker, yet highly effective, cleaning. At the same time, the commercial and industrial users must be water conservation minded to minimize water utility expense. Applicant cites just one example of the savings possible. With current water and sewer rates charged by utility companies, $10 a day in savings is easily possible, implying approximately $294 in monthly savings when the water conserving apparatus 10 is used daily. The nine nozzle embodiment meets their needs.

Continuing with describing FIG. 5, a typical spray pattern 78 for all embodiments is shown. For the seven nozzle embodiment, a spray angle $\partial_5$ 80 is approximately eighty (80) degrees. The air and water jet stream 48 length from each of the nozzles 36 to the surface 50 is approximately 3½ inches. And the pattern 78 overlaps each of the adjacent nozzles 36. Typically, the spray pattern 78 is 5¾ inches in width. Given that the distance between each of the nozzles 36 is approximately five inches, an overlap on each side of one of the given nozzles 36 is ¼ inch. Combining two adjacent nozzles 36 results in a ½ inch overlap. Therefore, the total cleaning path for this embodiment is 35 inches.

Figure 6A:
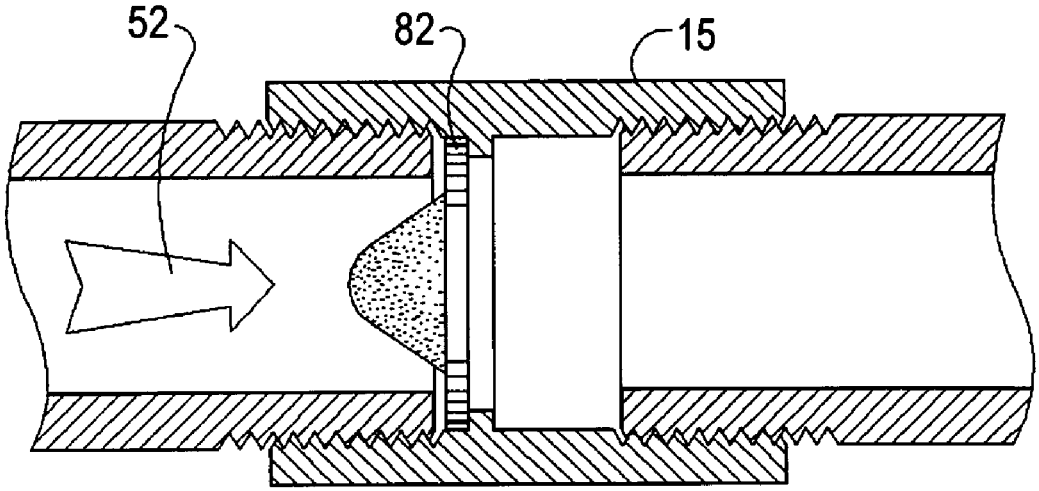
FIG. 6*a* is an enlarged detailed section view of a cone-shaped water filter inside the handle of the present invention.

Lastly referring to FIG. 6, an enlarged detailed section view of the handle 12 and a novel cone-shaped water filter is 82 of the present invention is shown. In FIG. 6*a*, the straight fixture 15 portion of the handle 12 illustrates the approximate location of the water filter 82. Although water filters are customarily inserted in lines to filter out impurities and particulates, the present filter 82 has novel features.

Figure 6B:
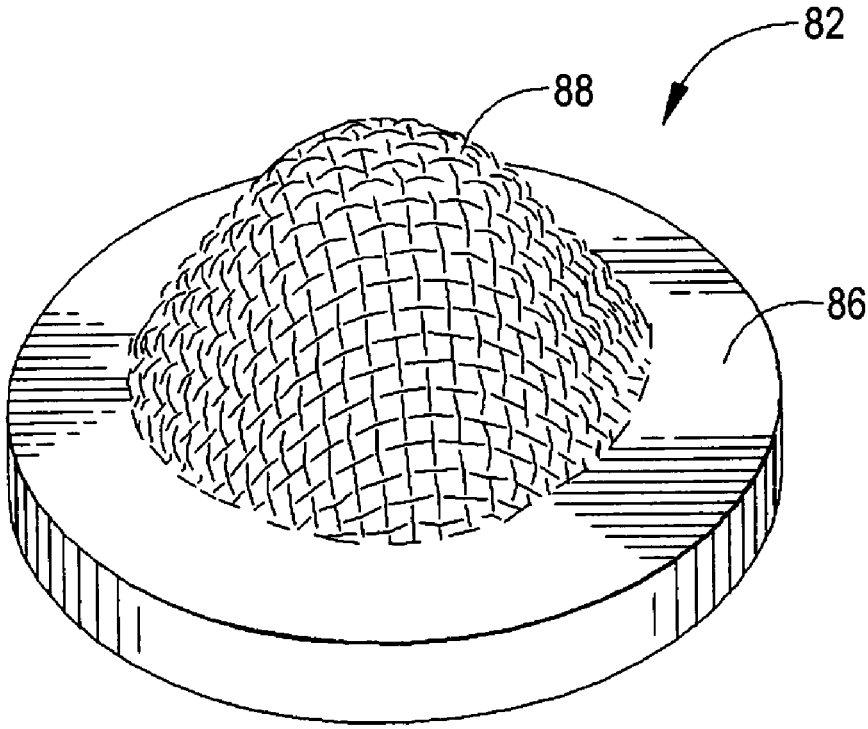
FIG. 6*b* is an enlarged perspective view of the filter.

More specifically, in FIG. 6*b*, an enlarged perspective view of the filter 82 is shown. An essentially circular base 84 is formed into an annular ring 86 into which is secured a cone 88. The cone 88 is manufactured from metal into a porous screen with a grid size which is approximately twice as small as a nozzle orifice (not shown) planned for use in the present invention. More specifically, for an 8004 Vee-Jet™ nozzle, the orifice diameter is 0.052 inches. Therefore, the grid size for the cone 88 would be about 0.026 inches in width and length. FIG. 6*b* also shows the annular ring 86 of the base 84.

Referring back to FIG. 6*a*, one sees that the water 52 flows first against the cone 88. The cone shape provides a slope down which any particulates slide until contacting the annular ring 86. Periodically, the user of the present invention can turn off the water 52, twist open the fixture 15, and shake any particulates off the annular ring 86. In this novel manner, it is virtually impossible for the water conserving apparatus 10 to become clogged.

The present invention improves or provides the solutions to the many problems associated previously with manually operated watering devices used to clean surfaces by using water. Just a few of those solutions described herein include providing a durable device which will last a long time after many uses. The jet manifold 26 protects the nozzles 36 from damage, thereby ensuring long life. Another solution is providing a device which provides dramatic water conservation features, while still thoroughly cleaning a surface. A third solution is in providing an elegantly simple and inexpensively manufactured design, including a flexible design accommodating the needs of different users and supporting a variety of devices.

Consequently, while the foregoing description has described the principle and operation of the present invention in accordance with the provisions of the patent statutes, it should be understood that the invention may be practiced otherwise as illustrated and described above and that various changes in the size, shape, and materials, as well as on the details of the illustrated construction may be made, within the scope of the appended claims without departing from the spirit and scope of the invention.

What is claimed is:

1. A cleaning device, comprising:

an elongated handle;

an elongated hollow jet manifold defining a transverse dimension generally perpendicular to the handle, the jet manifold being engaged with a lower end portion of the handle without intervening structure between the manifold and handle;

plural nozzles spaced along the jet manifold for spraying water directed into the jet manifold onto a surface;

a flat forward wing extending from the jet manifold above and forwardly of the nozzles such that water from the nozzles can spray beyond the forward wing during operation, the forward wing being elongated in the transverse dimension;

a flat rear wing elongated in the transverse dimension and having a front transverse edge engaged with the jet manifold, the rear wing extending rearwardly of the nozzles and terminating in a rear transverse edge, the forward wing being slanted with respect to the rear wing being substantially parallel to the ground when the device is being used to spray the ground, an air flow space being defined between the rear transverse edge and a surface beneath the device when the device is rollably engaged with she surface to clean the surface; and at least one wheel on the device to rollably engage the surface, wherein the wings cooperate to establish a Venturi effect when water is sprayed onto the surface through the nozzles, wherein air outside the jet manifold below the wings is entrained into water being sprayed from the nozzles onto the surface, thereby facilitating cleaning the surface with both the water and the air.

2. The device of claim 1, wherein the forward wing extends down from the horizontal in a longitudinal dimension that is perpendicular to the transverse dimension when the device is oriented to clean a surface beneath the device.

3. The device of claim 1, wherein the handle is hollow and defines a fluid passageway communicating with the jet manifold, the handle including a water connector connectable to a source of water for directing water through the handle, jet manifold, and nozzles.

4. The device of claim 3, further comprising a valve on the handle and manipulable to block the fluid passageway.

5. The device of claim 1, wherein water flow onto the surface is no more than three gallons per minute at a water source pressure of up to eighty pounds per square inch.

6. The device of claim 3, comprising a filter disposed in the fluid passageway of the handle.

7. The device of claim 6, wherein said filter is frustoconical shaped.

8. A cleaning device, comprising:

an elongated handle;

an elongated hollow jet manifold generally perpendicular to the handle, the jet manifold being fixedly engaged with a lower end portion of the handle;

plural nozzles on the jet manifold for spraying water directed into the jet manifold onto a surface;

a flat transversely elongated forward wing extending from the jet manifold forwardly of the nozzles;

a transversely elongated unitary rear wing extending from the jet manifold rearwardly of the nozzles and terminating in a rear transverse edge without further structure rearwardly of the rear transverse edge that is closer to the ground during operation than the rear wing, an air flow space being defined between the rear transverse edge and a surface beneath the device when the device is rollably engaged with the surface to clean the surface;

at least one wheel engaged with the device to rollably engage the surface, wherein the wings cooperate with each other such that air outside the jet manifold between the wings and a surface being cleaned and air from behind the rear wing is entrained into water being sprayed from the nozzles onto the surface, thereby facilitating cleaning the surface with both the water and the air.

9. The device of claim 8, wherein the forward wing extends down from the horizontal in a longitudinal dimension when the device is oriented to clean a surface beneath the device.

10. The device of claim 8, wherein the handle is hollow and defines a fluid passageway communicating with the jet manifold, the handle including a water connector connectable to a source of water for directing water through the handle, jet manifold, and nozzles.

11. The device of claim 10, further comprising a valve on the handle and manipulable to block the fluid passageway.

12. The device of claim 8, wherein water flow onto the surface is no more than three gallons per minute at a water source pressure of up to eighty pounds per square inch.

13. The device of claim 10, comprising a filter disposed in the fluid passageway of the handle.

14. The device of claim 13, wherein said filter is frustoconical shaped.

* * * * *